US005672467A

United States Patent [19]

Buitano et al.

[11] Patent Number: 5,672,467

[45] Date of Patent: Sep. 30, 1997

[54] HIGHER SPEED COLOR PHOTOGRAPHIC ELEMENT AND A METHOD FOR HIGH SPEED IMAGING

[75] Inventors: Lois Ann Buitano, Rochester; Robert Lawrence Bittner, Palmyra, both of N.Y.

[73] Assignee: Eastman Kodak Company, Rochester, N.Y.

[21] Appl. No.: 602,525

[22] Filed: Feb. 20, 1996

[51] Int. Cl.[6] ..... G03C 1/035

[52] U.S. Cl. ..... 430/363; 430/567; 430/945; 430/494; 430/394; 430/484; 430/435

[58] Field of Search ..... 430/567, 363, 430/945, 494, 394, 484, 435

[56] References Cited

U.S. PATENT DOCUMENTS

| | | | |
|---|---|---|---|
| 4,439,520 | 3/1984 | Kofron et al. | 430/434 |
| 5,292,632 | 3/1994 | Maskasky | 430/567 |
| 5,314,798 | 5/1994 | Brust et al. | 430/567 |
| 5,320,938 | 6/1994 | House et al. | 430/567 |
| 5,413,904 | 5/1995 | Chang et al. | 430/569 |
| 5,451,490 | 9/1995 | Budz et al. | 430/567 |

OTHER PUBLICATIONS

James and Higgins, *Fundamentals of Photographic Theory*, Morgan and Morgan, 1960, p. 10.

Keller *Science and Technology of Photography*, VCH, 1993, p. 38.

*Primary Examiner*—Mark F. Huff

*Attorney, Agent, or Firm*—Carl O. Thomas

[57] ABSTRACT

A dye image forming photographic element is disclosed containing at least one green or red sensitized silver halide emulsion layer containing a dye-forming coupler and silver halide grains. At least 50 percent of the projected area of the silver halide grains is accounted for by grains (a) containing greater than 50 mole percent chloride, based on silver, (b) having {100} major faces, (c) exhibiting a thickness of 0.2 μm or less, (d) exhibiting a mean equivalent lent circular diameter in the range of from 3 to 6 μm, and (e) including a core and a surrounding band containing a higher level of iodide ions than the core and up to 30 percent of the silver forming the grains. The photographic element exhibits a sensitivity of greater than 750, where sensitivity is measured as the reciprocal of the exposure in lux-seconds required to produce a density of 0.15 above fog when the photographic element is exposed to a 3000° K. tungsten light source filtered to transmit light between 460 and 700 nm and developed for 3 minutes and 15 seconds at 38° C. in a reference developer, bleached and fixed. The photographic element when exposed to $1.33\times10^{-3}$ lux-seconds of at least one of green and red light during imagewise exposure produces a density of at least 0.15 above fog when processed in the referenced developer, bleached and fixed.

12 Claims, No Drawings

HIGHER SPEED COLOR PHOTOGRAPHIC ELEMENT AND A METHOD FOR HIGH SPEED IMAGING

FIELD OF THE INVENTION

The invention pertains to a color photographic element of increased speed and to a method for high speed imaging. More specifically, the invention relates to a color photographic element containing at least one silver halide emulsion layer chosen to provide an increased photographic speed and to a method of high speed imaging employing the color photographic element.

DEFINITION OF TERMS

In referring to silver halide grains or emulsions containing two or more halides, the halides are named in order of ascending concentrations. Optional minor component halides are parenthetically indicated—e.g., silver (iodo) bromide refers to silver bromide grains and emulsions optionally containing minor amounts of iodide.

The term "high chloride" in referring to silver halide grains and emulsions is employed to indicate greater than 50 mole percent chloride, based on total silver forming the grains and emulsions, respectively.

The term "equivalent circular diameter" (ECD) of a grain is the diameter of a circle having an area equal to the projected area of the grain.

The term "aspect ratio" of a silver halide is the ratio of its ECD divided by its thickness (t).

The term "tabular grain" is defined as a grain having an aspect ratio of at least 2.

The term "tabular grain emulsion" is defined as an emulsion in which at least 50 percent of total grain projected area is accounted for by tabular grains.

The term "thin tabular" in referring to grains refers to tabular grains having a thickness of 0.2 μm or less.

The terms "{100} tabular" and "{111} tabular" in referring to tabular grains and emulsions are employed to indicate that the tabular grains have major faces that lie in {100} and {111} crystal lattice planes, respectively.

The term "reciprocity failure" is employed to indicate departures from the law of photographic reciprocity, which states that the observed speed of a photographic element should remain constant so long as the product of varied exposure intensities and times remains constant.

The term "oxidized gelatin" refers to gelatin that has been treated with an oxidizing agent to remove methionine.

Contrast (γ) is measured as the slope of a line drawn between the speed point (Dmin+0.15) and a characteristic curve point offset from the speed point by 0.6 log E, where E represents exposure in lux-seconds.

*Research Disclosure* is published by Kenneth Mason Publications, Ltd., Dudley House, 12 North St., Emsworth, Hampshire P010 7DQ, England.

BACKGROUND

Kofron et al U.S. Pat. No. 4,439,520 ushered in the current era of high speed, high performance silver halide photography. Kofron et al disclosed and demonstrated striking photographic advantages for chemically and spectrally sensitized tabular grain emulsions in which tabular grains having a diameter of at least 0.6 μm and a thickness of less than 0.3 μm exhibit an average aspect ratio of greater than 8 and account for greater than 50 percent of total grain projected area. Kofron et al demonstrated advantages in terms of increased speed, improved speed-granularity relationships, increased image sharpness, and relatively reduced blue sensitivity in minus blue (green and/or red) sensitized silver iodobromide emulsions.

The speed and speed-granularity comparisons provided by Kofron et al are limited to silver (iodo)bromide emulsions. This followed the general recognition in the art that high chloride emulsions are generally suitable only for low speed imaging applications. For example, James and Higgins, *Fundamentals of Photographic Theory*, Morgan and Morgan, 1960, states at page 10:

The silver halide most commonly employed is the bromide, with or without the addition of small amounts of iodide. Some slow photographic emulsions, however, contain only silver chloride, and some contain a mixture of chloride and bromide.

Although Kofron et al discloses that the mean ECD's of the tabular grains can be quite large, only sharpness advantages are demonstrated for emulsions with mean ECD's in excess of 3.0 μm. Not only did Kofron et al limit its speed investigations on the assumption that silver (iodo)bromide tabular grain emulsions would produce the highest photographic speeds, it additionally limited its speed and speed-granularity investigations to silver (iodo)bromide emulsions having mean ECD's of less than 3.0 μm. This, again, was based on a general recognition in the art that silver (iodo) bromide emulsions show an increase in speed as grain size in increased until a maximum speed is reached. Further increases in the mean ECD's of emulsion grains results in an actual decline in photographic sensitivity levels. This is illustrated by Keller *Science and Technology of Photography*, VCH, 1993, which states at page 38:

> The sensitivity or speed of emulsion depends, above all, on the grain size. The larger the grains, the greater the number of incident photons per grain at a given exposure, and thus the higher the probability that a latent-image center will be formed . . .
>
> FIG. 15 shows that these linear functions are valid only up to some limiting values; beyond these levels (dashed curves), the sensitivity increases more slowly and eventually decreases because of loss reactions in latent-image formation.

In FIG. 15 Keller shows speeds to be peaking out with both tabular and compact (non-tabular) emulsions at an ASA rating of about 1000. Applying an approximate conversion, ASA÷1.414 (the square root of 2), this translates to a sensitivity of about 700, where sensitivity is the reciprocal of exposure measured in lux-seconds.

Maskasky U.S. Pat. No. 5,292,632 and House et al U.S. Pat. No. 5,320,938 were the first to produce high (>8) aspect ratio high chloride {100} tabular grain emulsions. Subsequently Brust et al U.S. Pat. No. 5,314,798 demonstrated that increased photographic speeds could be realized by forming on the host tabular grains a higher iodide band containing up to 30 percent of the total silver forming the grains. Although each of Maskasky, House et al and Brust et al contemplated mean ECD's ranging up to 10 μm, no actual speed investigations are reported of high chloride {100} tabular grain emulsions having a mean ECD as high as 3.0 μm. Thus Maskasky, House et al and Brust et al, like Kofron et al, proceeded on the common assumption that the highest speeds would be produced with mean grain ECD's of less than 3 μm.

SUMMARY OF THE INVENTION

In one aspect the invention is directed to a dye image forming photographic element comprised of a transparent film support and, coated on the support, at least one layer containing a silver halide emulsion containing chemically sensitized silver halide grains, a spectral sensitizing dye having a peak absorption in the green or red region of the spectrum adsorbed to the silver halide grains, a dye-forming coupler and a dispersing medium, wherein at least 50 percent of the projected area of the silver halide grains is accounted for by grains (a) containing greater than 50 mole percent chloride, based on silver, (b) having {100} major faces, (c) exhibiting a thickness of 0.2 μm or less, (d) exhibiting a mean equivalent circular diameter in the range of from 3 to 6 μm, and (e) including a core and a surrounding band containing a higher level of iodide ions than the core and up to 30 percent of the silver forming the grains, the photographic element exhibiting a sensitivity of greater than 750, where sensitivity is measured as the reciprocal of the exposure in lux-seconds required to produce a density of 0.15 above fog when the photographic element is exposed to a 3000° K. tungsten light source filtered to transmit light between 460 and 700 nm and developed for 3 minutes and 15 seconds at 38° C. in a developer of the composition:

| | |
|---|---|
| Potassium carbonate, anhydrous | 34.30 g |
| Potassium bicarbonate | 2.32 g |
| Sodium sulfite, anhydrous | 0.38 g |
| Sodium metalsulfite | 2.78 g |
| Potassium iodide | 1.20 mg |
| Sodium bromide | 1.31 g |
| Diethylenetriaminepentaacetic acid, pentasodium salt (40% solution) | 8.43 g |
| Hydroxylamine sulfate | 2.41 g |
| Water to 1 Liter | |
| pH 10 | |

and subsequently bleached and fixed.

In another aspect the invention is directed to a method of imagewise exposing to at least one of green and red light a dye image forming photographic element comprised of a transparent film support and, coated on the support, at least one layer unit containing a silver halide emulsion containing chemically sensitized silver halide grains, adsorbed to the silver halide grains a spectral sensitizing dye having a peak absorption in the green or red region of the spectrum to which the photographic element is exposed, a dye-forming coupler and a dispersing medium, wherein exposure of at least one portion of the photographic element is limited to $1.33\times10^{-3}$ lux-seconds and at least 50 percent of the projected area of the silver halide grains is accounted for by grains (a) containing greater than 50 mole percent chloride, based on silver, (b) having {100} major faces, (c) exhibiting a thickness of 0.2 μm or less, (d) exhibiting a mean equivalent lent circular diameter in the range of from 3 to 6 μm, and (e) including a core and a surrounding band containing a higher level of iodide ions than the core and up to 30 percent of the silver forming the grains, so that when the photographic element is developed for 3 minutes and 15 seconds at 38° C. in a developer of the composition:

| | |
|---|---|
| Potassium carbonate, anhydrous | 34.30 g |
| Potassium bicarbonate | 2.32 g |
| Sodium sulfite, anhydrous | 0.38 g |
| Sodium metalsulfite | 2.78 g |
| Potassium iodide | 1.20 mg |
| Sodium bromide | 1.31 g |
| Diethylenetriaminepentaacetic acid, pentasodium salt (40% solution) | 8.43 g |
| Hydroxylamine sulfate | 2.41 g |
| Water to 1 Liter | |
| pH 10 | |

and subsequently bleached and fixed, it exhibits a density above fog of at least 0.15 above fog in the at least one portion of the photographic element receiving an exposure of $1.33\times10^{-3}$ lux seconds.

In addition to the advantages known to be realized when high chloride emulsions are substituted for high bromide emulsions (e.g., lower native blue sensitivity, more rapid development, and increased ecological compatibility), it has been discovered that the photographic elements of the invention containing high chloride {100} tabular grain emulsions can realize higher speeds than have heretofore been obtained with any conventional emulsion, including silver iodobromide tabular grain emulsions.

Further, it is has been observed that the photographic elements of the invention exhibit unexpectedly low levels of pressure sensitivity. Still further, low levels of reciprocity failure have been observed without recourse to iridium dopants conventionally employed to reduce reciprocity failure.

The photographic elements of the invention are suitable for use in methods of imagewise exposure that provide insufficient light to expose conventional photographic elements. Additionally, contrary to what would be expected from such high levels of light sensitivity, the sensitivity of the photographic elements of the invention to high energy background radiation (e.g., cosmic radiation) is surprisingly lower than that of photographic elements containing high speed silver bromide tabular grain emulsions.

DESCRIPTION OF PREFERRED EMBODIMENTS

In a simple, illustrative embodiment a dye image forming photographic element according to the invention can take the following form:

| Layer Unit |
|---|
| Transparent Film Support |

Single Color Element

In the Single Color Element construction shown above a layer unit consisting of a single silver halide emulsion layer is coated on transparent film support. The emulsion layer contains chemically sensitized silver halide grains, adsorbed to the silver halide grains a spectral sensitizing dye having a peak absorption in the green or red region of the spectrum, a dye-forming coupler, and a dispersing medium.

It has been discovered quite surprisingly that higher speeds than have heretofore been realized in the art can be obtained by selecting a high chloride {100} tabular grain emulsion heretofore regarded as having a mean grain ECD too large to be useful for achieving maximum photographic speeds. Specifically, at least 50 percent of the projected area of the silver halide grains forming the emulsion is accounted for by grains (a) containing greater than 50 mole percent chloride, based on silver, (b) having {100} major faces, (c) exhibiting a thickness of 0.2 μm or less, (d) exhibiting a mean equivalent circular diameter in the range of from 3 to 6 μm, and (e) including a core and a surrounding band containing a higher level of iodide ions than the core and up to 30 percent of the silver forming the grains.

It is generally preferred that the high chloride {100} tabular grains account for at least 70 percent of total grain projected area and optimally at least 90 percent. Emulsions in which the high chloride {100} tabular grains account for substantially all (i.e., >97%) of total grain projected area are specifically contemplated and can be realized with well controlled emulsion precipitations.

The unexpectedly high speeds that have been observed are a function of the mean ECD's of the high chloride {100} tabular grains. Speeds higher than those of silver iodobromide {111} tabular grain emulsions, the highest speed emulsions previously known in the art, have been realized by increasing the minimum mean ECD of the high chloride {100} tabular grains to at least 3 μm. Specifically, it has been observed that, whereas the fastest reported conventional emulsions can be increased in speed by increasing mean grain ECD's up to a peak sensitivity (S) of about 700 and further increases in mean ECD's result in actual declines in sensitivity, high chloride {100} tabular grain emulsions as employed in the photographic elements of the invention exhibit a sensitivity (S) of greater than 750 at a mean ECD of 3 μm. Investigation of larger mean ECD high chloride {100} tabular grain emulsions satisfying invention requirements have not revealed any larger mean ECD at which sensitivity declines. It is, first, surprising that the 700 sensitivity barrier has been broken by the high chloride ride {100} tabular grain emulsions herein contemplated and, second, surprising that no upper sensitivity limit has been identified. Thus, in a surprising and wholly unpredicted manner the imaging properties of the high chloride {100} tabular grain emulsions are fundamentally different than those of the highest speed photographic emulsions heretofore known to the art.

For the sensitivity values named above, namely the 700 and 750 values, to be meaningful it is necessary to specify exactly how these numbers are determined. Sensitivity (S) is measured as the reciprocal of the exposure (H) in lux-seconds (S=1/H) required to produce a density of 0.15 above fog when the photographic element is exposed to a 3000° K. tungsten light source filtered to transmit light between 460 and 700 nm and developed for 3 minutes and 15 seconds at 38° C. in a Reference Developer, bleached and fixed.

The Reference Developer has the following composition:

| | |
|---|---|
| Potassium carbonate, anhydrous | 34.30 g |
| Potassium bicarbonate | 2.32 g |
| Sodium sulfite, anhydrous | 0.38 g |
| Sodium metalsulfite | 2.78 g |
| Potassium iodide | 1.20 mg |
| Sodium bromide | 1.31 g |
| Diethylenetriaminepentaacetic acid, pentasodium salt (40% solution) | 8.43 g |
| Hydroxylamine sulfate | 2.41 g |
| Water to 1 Liter | |
| pH 10. | |

From another point of view, the photographic elements of the invention are unique in being capable of producing an image density of at least 0.15 above fog when spectrally sensitized to green or red light, exposed to no more than $1.33\times10^{-3}$ lux-seconds of light in the spectral region of spectral sensitization, and processed as described. The exposure (H) of $1.33\times10^{-3}$ lux-seconds is the reciprocal of the sensitivity (S) 750, noted above.

Although there is no theoretical limit on the photographic speeds that might be attained with the photographic elements of the invention, other practical imaging needs must, of course, be balanced. Investigations reveal that photographic elements according to the invention having practical imaging properties can be constructed with sensitivities in the range of from 750 to 2000 (approximately corresponding to ISO speed ratings within the range of from 1000 to 3000). Preferred photographic elements according to the invention exhibit sensitivity levels of 1000 and higher, which approximate ISO speed ratings of 1400 and higher.

To maintain practically acceptable levels of dye image quality (e.g., acceptably low levels of granularity), it is contemplated to limit both the thickness and mean ECD of the high chloride {100} tabular grains. Thus, mean ECD's of up to only about 6.0 μm are contemplated, even though still larger mean ECD's are expected to result in higher photographic speeds. Further, the {100} tabular grains satisfying the projected criteria set out above are limited to maximum thicknesses of 0.2 μm or less. That is, the high chloride {100} tabular grains are thin tabular grains.

As the mean ECD of the tabular grains increases, it is recognized that the mean thicknesses of the tabular grains also increase. Prior to the present invention no high chloride {100} tabular grain emulsion preparation has demonstrated both the capability of producing both mean ECD's at or above 3 μm and thin tabular grains. The emulsion precipitations in the Examples of this patent application are the first to demonstrate the capability of combining mean tabular grain ECD's in the range of from 3 to 6 μm and mean tabular grain thicknesses of 0.2 μm or less in the preparation of high chloride {100} tabular grain emulsions. The precipitation processes demonstrated in the Examples below are capable of producing 3 to 6 μm high chloride {100} tabular grain emulsions in which the tabular grains satisfying the projected area requirements set out above are in the range of from 0.1 to 0.2 μm. It is believed that optimization of these precipitation processes should result in high chloride {100} tabular grain emulsions in which the tabular grain projected area criteria set out above are satisfied by high chloride {100} tabular grains having thicknesses of less than 0.1 μm.

The high chloride {100} tabular grain structures of the invention, with their unique combination of grain thicknesses and mean ECD's described above, also contain the speed enhancing iodide placements that are demonstrated by Brust et al U.S. Pat. No. 5,314,789, the disclosure of which is here incorporated by reference. Specifically, each of the {100} tabular grains is grown to form a core portion onto which a surrounding band is grown containing a higher level of iodide ions and containing up to 30 percent of the silver forming the completed tabular grains. The band is formed after at least 5 percent of the silver forming the tabular grains has been precipitated (i.e., the core portion accounts for at least 5 percent of total silver). It is preferred that the core portion account for at least 25 percent and, most preferably, at least 50 percent of total silver. This does not, however, mean that the balance of the total silver must be entirely present in the band, since after the higher iodide band is formed, additional precipitation can occur containing lower levels of iodide or no iodide.

The band portion preferably constitutes up to 5 percent of total silver and optimally up to 2 percent of total silver. In the preferred form of the invention the higher iodide band adds sufficient iodide to increase the average iodide content of the high chloride {100} tabular grains by at least 0.1 mole percent and, optimally, at least 0.2 mole percent. The maximum silver content of the band sets a theoretical upper limit on iodide incorporation by the band. To avoid renucleation during precipitation it is generally preferred to limit the iodide concentration of the band to up to 2 mole percent above the average iodide content of the grain core.

Although the speed enhancement of the higher iodide band cannot be entirely explained theoretically, it is believed that the higher iodide concentrations in the band portion of the tabular grains increase crystal lattice defects that facilitate latent image formation. Thus, generally higher iodide concentrations in the band, within the concentration limits noted above, and more rapid iodide introduction during formation of the band portions of the tabular grains both contribute to achieving higher photographic speeds. Thus, preferred iodide introduction during precipitation of the band portion of the grains is by the so-called "dump" method. That is, the rate of iodide introduction is not intentionally rate limited, but is introduced as nearly instantaneously as equipment limitations will permit.

The precipitation of the high chloride {100} tabular grains, both before and after band formation, can take any of the various forms disclosed by Maskasky U.S. Pat. No. 5,292,632, House et al U.S. Pat. No. 5,320,938, Brust et al U.S. Pat. No. 5,314,798, Szajewski et al U.S. Pat. No. 5,356,764, and Budz et al U.S. Pat. No. 5,451,490, the disclosures of which are here incorporated by reference. These procedures are controlled and modified as demonstrated in the Examples below to produce high chloride, thin {100} tabular grain emulsions in the mean ECD ranges contemplated by the invention.

In a typical color recording photographic element according to the invention capable of recording sufficient image information to allow the image and colors of the photographic subject to be reproduced, either within the color recording photographic element itself or in another color recording photographic element, the color recording photographic element can be constructed as follows:

| |
|---|
| Protective Overcoat |
| 3rd Color Recording Layer Unit |
| 2nd Interlayer |
| 2nd Color Recording Layer Unit |
| 1st Interlayer |
| 1st Color Recording Layer Unit |
| Undercoat |
| Transparent Film Support |
| Pelloid |
| Magnetic Imaging Layer |

Color Recording Element

The Support and the 1st, 2nd and 3rd Color Recording Layer Units are essential components for all color recording applications. The remaining components are either optional or required only in specific applications.

Each of the layer units records exposure in a different one of the blue, green and red portions of the visible spectrum. Any one of the following layer unit sequences are possible:

| | |
|---|---|
| SQ-1 | IBIGIRI S I, |
| SQ-2 | IBIRIGI S I, |
| SQ-3 | IGIRIBI S I, |
| SQ-4 | IRIGIBI S I, |
| SQ-5 | IGIBIRI S I, and |
| SQ-6 | IRIBIGI S I |

where

B=Blue Recording Layer Unit,

G=Green Recording Layer Unit,

R=Red Recording Layer Unit, and

S=Transparent Film Support.

The blue, green and red recording layer units contain a yellow dye-forming coupler, a magenta dye-forming coupler, and a cyan dye-forming coupler, respectively. In addition, each of the layer units contains one, two or three silver halide emulsion layers. Two or three emulsion layers differing in sensitivity are contemplated to be incorporated within a single layer unit to arrive at superior speed-granularity relationships and to extend exposure latitude. The highest sensitivity emulsion layer in at least one of the green and red recording layer units, preferably both, and, most preferably, each of the blue, green and red recording layer units contains a high chloride {100} tabular grain emulsion having a sensitivity of at least 750 of the type previously described. The remaining emulsion layers, if any, can take any convenient conventional form. It is specifically contemplated to employ conventional high chloride {100} and/or {111} tabular grain emulsions having mean grain ECD's of up to 3.0 μm to form lower sensitivity emulsion layers.

The following patents, the disclosures of which are here incorporated by reference, disclose high chloride {111} tabular grain emulsions having mean grain ECD's of up to 3 μm and their preparation:

| | |
|---|---|
| Wey et al | U.S. Pat. No. 4,414,306; |
| Maskasky | U.S. Pat. No. 4,400,463; |
| Maskasky | U.S. Pat. No. 4,713,323; |
| Takada et al | U.S. Pat. No. 4,783,398; |
| Nishikawa et al | U.S. Pat. No. 4,952,491; |
| Ishiguro et al | U.S. Pat. No. 4,983,508; |
| Tufano et al | U.S. Pat. No. 4,804,621; |
| Maskasky | U.S. Pat. No. 5,061,617; |
| Maskasky | U.S. Pat. No. 5,178,997; |
| Maskasky and Chang | U.S. Pat. No. 5,178,998; |
| Maskasky | U.S. Pat. No. 5,183,732; |
| Maskasky | U.S. Pat. No. 5,185,230 |
| Maskasky | U.S. Pat. No. 5,217,858; |
| Chang et al | U.S. Pat. No. 5,252,452; |
| Maskasky | U.S. Pat. No. 5,298,387; |
| Maskasky | U.S. Pat. No. 5,298,388. |

The following patents, the disclosures of which are here incorporated by reference, disclose high chloride {100} tabular grain emulsions with mean grain ECD's of up to 3.0 μm and their preparation:

| | |
|---|---|
| Maskasky | U.S. Pat. No. 5,264,337; |
| Maskasky | U.S. Pat. No. 5,292,632; |
| Brust et al | U.S. Pat. No. 5,314,798; |
| House et al | U.S. Pat. No. 5,320,938; |
| Chang et al | U.S. Pat. No. 5,413,904. |

The lower or lowest speed high chloride emulsion incorporated within a layer unit can contain conventional nontabular grains. High chloride nontabular grain emulsions are illustrated by the high chloride cubic grain conventionally employed in reflection print photographic elements. Such emulsions are illustrated by the following:

| | |
|---|---|
| Hasebe et al | U.S. Pat. No. 4,865,962; |
| Suzumoto et al | U.S. Pat. No. 5,252,454; |
| Ohshima et al | U.S. Pat. No. 5,252,456. |

Conventional emulsion choices including and extending beyond the high chloride emulsions previously described are illustrated by the following:

RESEARCH DISCLOSURE

Vol. 365, September 1994, Item 36544 I. Emulsion grains and their preparation

Vol. 370, February 1995, Item 37038 XIV. Emulsions

A. Tabular Grain Emulsions

The sensitivity of the emulsions can be increased by the epitaxial deposition of a silver salt onto the silver halide grains. Epitaxial deposition is sometimes classified as a modification of the grain structure, which it is, and sometimes treated as a form of chemical sensitization, since, as typically undertaken, it alone produces a large proportion of the total increase in speed attainable. Epitaxial deposition onto high chloride {100} tabular grains is demonstrated by Maskasky U.S. Pat. No. 5,275,930. Other useful conventional epitaxial depositions onto high chloride silver halide grains are illustrated by Maskasky U.S. Pat. No. 4,435,501 (particularly Example 24B); Ogawa et al U.S. Pat. Nos. 4,786,588 and 4,791,053; Hasebe et al U.S. Pat. Nos. 4,820,624 and 4,865,962; Sugimoto and Miyake, "Mechanism of Halide Conversion Process of Colloidal AgCl Microcrystals by $Br^-$ Ions", Parts I and II, *Journal of Colloid and Interface Science*, Vol. 140, No. 2, December 1990, pp. 335–361; Houle et al U.S. Pat. No. 5,035,992; and Japanese published applications (Kokai) 252649-A (priority 02.03.90-JP 051165 Japan) and 288143-A (priority 04.04.90-JP 089380 Japan). The disclosures of the above U.S. patents are here incorporated by reference. A more general description of conventional epitaxial deposition techniques is provided by *Research Disclosure*, Item 36544, I. Emulsion grains and their preparation, A. Grain composition, paragraph (5).

In the course of grain precipitation one or more dopants (grain occlusions other than silver and halide) can be introduced to modify grain properties. It has been discovered quite surprisingly that the high chloride {100} tabular grain emulsions containing thin tabular grains with mean ECD's in the range of from 3.0 to 6.0 μm show low levels of reciprocity failure even when the dopants (typically iridium in the form of a hexacoordination complex) customarily introduced to reduce reciprocity failure are absent. This offers the advantage not only of improved performance, but also of simplified emulsion preparation and grain structure. It is, of course, possible to employ iridium and other conventional reciprocity failure reducing dopants, if desired.

Although not required to reach sensitivity levels of 750 and higher as described above, it is recognized that shallow electron trapping (SET) dopants can be employed to provide a further increase in sensitivity. A comprehensive description of SET dopants is provided by *Research Disclosure*, Vol. 367, November 1994, Item 36736.

In a specific preferred form it is contemplated to employ as a SET dopant a hexacoordination complex satisfying the formula:

$$[ML_6]^n \quad (I)$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −1, −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |

-continued

| | |
|---|---|
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N3)]^{-4}$ |
| SET-18 | $[OS(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[OS(CN)Cl_5]^{-4}$ |
| SET-24 | $[Co)(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |
| SET-28 | $[Pt(CN)_4(H_2O)_2]^{-1}$ |

The SET dopants are effective at any location within the grains, including in the silver salt epitaxy, if present. Generally better results are obtained when the SET dopant is incorporated in the exterior 50 percent of the grain, based on silver. To insure that the dopant is in fact incorporated in the grain structure and not merely associated with the surface of the grain, it is preferred to introduce the SET dopant prior to forming the maximum iodide concentration region of the grain. Thus, an optimum grain region for SET incorporation is that formed by silver ranging from 50 to 85 percent of total silver forming the grains. That is, SET introduction is optimally commenced after 50 percent of total silver has been introduced and optimally completed by the time 85 percent of total silver has precipitated. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

The contrast of the photographic elements of the invention containing high chloride {100} tabular grain emulsions can be further increased by doping the grains with a hexacoordination complex containing a nitrosyl or thionitrosyl ligand. Preferred coordination complexes of this type are represented by the formula:

$$[TE_4(NZ)E']^r \quad (I)$$

where

T is a transition metal;

E is a bridging ligand;

E' is E or NZ;

r is zero, −1, −2 or −3; and

Z is oxygen or sulfur.

The E ligands are typically halide, but can take any of the forms found in the SET dopants discussed above. A listing of suitable coordination complexes satisfying formula II is found in McDugle et al U.S. Pat. No. 4,933,272, the disclosure of which is here incorporated by reference.

The contrast increasing dopants (hereinafter also referred to as NZ dopants) can be incorporated in the grain structure at any convenient location. However, if the NZ dopant is present at the surface of the grain, it can reduce the sensitivity of the grains. It is therefore preferred that the NZ dopants be located in the grain so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

After precipitation and before chemical sensitization the emulsions can be washed by any convenient conventional technique. Conventional washing techniques are disclosed by *Research Disclosure*, Item 36544, cited above, Section III. Emulsion washing.

The emulsions are chemically and spectrally sensitized. Conventional chemical and spectral sensitization techniques are illustrated by the following:

RESEARCH DISCLOSURE

Item 36544
- IV. Chemical sensitization
- V. Spectral sensitization and desensitization Item 37038
- XV. Emulsions, including particularly,
  - E. Spectral sensitization
  - F. Structures of Typical Sensitizing Dyes Techniques for the chemical and spectral sensitization of tabular grain emulsions are disclosed by Kofron et al U.S. Pat. No. 4,439,520. Preferred techniques for chemically sensitizing high chloride {100} tabular grain emulsions are disclosed in the patents cited above to show conventional high chloride {100} tabular grain emulsions.

The high chloride {100} tabular grain emulsions can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3, 5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

The following illustrate specific spectral sensitizing dye selections:

SS-1

Anhydro-5'-chloro-3'-di-(3-sulfopropyl)naphtho[1,2-d]thiazolothiacyanine hydroxide, sodium salt

SS-2

Anhydro-5'-chloro-3'-di-(3-sulfopropyl)naphtho[1,2-d]oxazolothiacyanine hydroxide, sodium salt

SS-3

Anhydro-4,5-benzo-3'-methyl-4'-phenyl-1-(3-sulfopropyl)naphtho[1,2-d]thiazolothiazolocyanine hydroxide

SS-4

1,1'-Diethylnaphtho[1,2-d]thiazolo-2'-cyanine bromide

SS-5

Anhydro-1,1'-dimethyl-5,5'-di-(trifluoromethyl)-3-(4-sulfobutyl)-3'-(2,2,2-trifluoroethyl)benzimidazolocarbocyanine hydroxide

SS-6

Anhydro-3,3'-(2-methoxyethyl)-5,5'-diphenyl-9-ethyloxacarbocyanine, sodium salt

SS-7

Anhydro-11-ethyl-1,1'-di-(3-sulfopropyl)naphtho[1,2-d]oxazolocarbocyanine hydroxide, sodium salt

SS-8

Anhydro-5,5'-dichloro-9-ethyl-3,3'-di-(3-sulfopropyl)oxaselenacarbocyanine hydroxide, sodium salt

SS-9

5,6-Dichloro-3',3'-dimethyl-1,1',3-triethylbenzimidazolo-3H-indolocarbocyanine bromide

SS-10

Anhydro-5,6-dichloro-1,1-diethyl-3-(3-sulfopropylbenzimidazolooxacarbocyanine hydroxide

SS-11

Anhydro-5,5'-dichloro-9-ethyl-3,3'-di-(2-sulfoethylcarbamoylmethyl)thiacarbocyanine hydroxide, sodium salt

SS-12

Anhydro-5',6'-dimethoxy-9-ethyl-5-phenyl-3-(3-sulfobutyl)-3'-(3-sulfopropyl)oxathiacarbocyanine hydroxide, sodium salt

SS-13

Anhydro-5,5'-dichloro-9-ethyl-3-(3-phosphonopropyl)-3'-(3-sulfopropyl)thiacarbocyanine hydroxide

SS-14

Anhydro-3,3'-di-(2-carboxyethyl)-5,5'-dichloro-9-ethylthiacarbocyanine bromide

SS-15

Anhydro-5,5'-dichloro-3-(2-carboxyethyl)-3'-(3-sulfopropyl)thiacyanine sodium salt

SS-16

9-(5-Barbituric acid)-3,5-dimethyl-3'-ethyltellurathiacarbocyanine bromide

SS-17

Anhydro-5,6-methylenedioxy-9-ethyl-3-methyl-3'-(3-sulfopropyl)tellurathiacarbocyanine hydroxide

SS-18

3-Ethyl-6,6'-dimethyl-3'-pentyl-9.11-neopentylenethiadicarbocyanine bromide

SS-19

Anhydro-3-ethyl-9,11-neopentylene-3'-(3-sulfopropyl)thiadicarbocyanine hydroxide

SS-20

Anhydro-3-ethyl-11,13-neopentylene-3'-(3-sulfopropyl)oxathiatricarbocyanine hydroxide, sodium salt

SS-21

Anhydro-5-chloro-9-ethyl-5'-phenyl-3'-(3-sulfobutyl)-3-(3-sulfopropyl)oxacarbocyanine hydroxide, triethylammonium salt

SS-22

Anhydro-5,5'-dichloro-3,3'-di-(3-sulfopropyl)-9-ethyloxacarbocyanine hydroxide, sodium salt

SS-23

Anhydro-5,5'-dichloro-3,3'-di-(3-sulfopropyl)-9-ethylthiacarbocyanine hydroxide, triethylammonium salt

SS-24

Anhydro-5,5'-dimethyl-3,3'-di-(3-sulfopropyl)-9-ethylthiacarbocyanine hydroxide, sodium salt

SS-25

Anhydro-5,6-dichloro-1-ethyl-3-(3-sulfobutyl)-1'-(3-sulfopropyl)benzimidazolonaphtho[1,2-d]thiazolocarbocyanine hydroxide, triethylammonium salt

SS-26

Anhydro-11-ethyl-1,1'-di-(3-sulfopropyl)naphth[1,2-d]oxazolocarbocyanine hydroxide, sodium salt

SS-27

Anhydro-3,9-diethyl-3'-methylsulfonylcarbamoylmethyl-5-phenyloxathiacarbocyanine p-toluenesulfonate

SS-28

Anhydro-6,6'-dichloro-1,1'-diethyl-3,3'-di-(3-sulfopropyl)-5,5'-bis(trifluoromethyl)benzimidazolocarbocyanine hydroxide, sodium salt

SS-29

Anhydro-5'-chloro-5-phenyl-3,3'-di-(3-sulfopropyl)oxathiacyanine hydroxide, sodium salt

SS-30

Anhydro-5,5'-dichloro-3,3'-di-(3-sulfopropyl)thiacyanine hydroxide, sodium salt

SS-31

3-Ethyl-5-[1,4-dihydro-1-(4-sulfobutyl)pyridin-4-ylidene]rhodanine, triethylammonium salt

SS-32

1-Carboxyethyl-5-[2-(3-ethylbenzoxazolin-2-ylidene)ethylidene]-3-phenylthiohydantoin

SS-33

4-[2-((1,4-Dihydro-1-dodecylpyridinylidene)ethylidene]-3-phenyl-2-isoxazolin-5-one

SS-34

5-(3-Ethylbenzoxazolin-2-ylidene)-3-phenylrhodanine

SS-35

1,3 -Diethyl-5-{[1-ethyl-3-(3-sulfopropyl)benzimidazolin-2-ylidene]ethylidene}-2-thiobarbituric acid

SS-36

5-[2-(3-Ethylbenzoxazolin-2-ylidene)ethylidene]-1-methyl-2-dimethylamino-4-oxo-3-phenylimidazolinium p-toluenesulfonate

SS-37

5-[2-(5-Carboxy-3-methylbenzoxazolin-2-ylidene)ethylidene]-3-cyano-4-phenyl-1-(4-methylsulfonamido-3-pyrrolin-5-one

SS-38

2-[4-(Hexylsulfonamido)benzoylcyanomethine]-2-{2-{3-(2-methoxyethyl)-5-[(2-methoxyethyl)sulfonamido]-benzoxazolin-2-ylidene}ethylidene}acetonitrile

SS-39

3-Methyl-4-[2-(3-ethyl-5,6-dimethylbenzotellurazolin-2-ylidene)ethylidene]-1-phenyl-2-pyrazolin-5-one

SS-40

3-Heptyl-1-phenyl-5-{4-[3-(3-sulfobutyl)-naphtho[1,2-d]thiazolin]-2-butenylidene}-2-thiohydantoin

SS-41

1,4-Phenylene-bis(2-aminovinyl-3-methyl-2-thiazolinium] dichloride

SS-42

Anhydro-4-{2-[3-(3-sulfopropyl)thiazolin-2-ylidene] thylidene}-2-{3-[3-(3-sulfopropyl)thiazolin-2-ylidene] propenyl-5-oxazolium, hydroxide, sodium salt

SS-43

3-Carboxymethyl-5-{3-carboxymethyl-4-oxo-5-methyl -1,3,4-thiadiazolin-2-ylidene)ethylidene]thiazolin -2-ylidene}rhodanine, dipotassium salt

SS-44

1,3-Diethyl-5-[1-methyl-2-(3,5-dimethylbenzotellurazolin -2-ylidene)ethylidene]-2-thiobarbituric acid

SS-45

3-Methyl-4-[2-(3-ethyl-5,6-dimethylbenzotellurazolin-2-ylidene)-1-methylethylidene]-1-phenyl-2-pyrazolin -5-one

SS-46

1,3-Diethyl-5-[1-ethyl-2-(3-ethyl-5,6-dimethoxybenzotellurazolin -2-ylidene)ethylidene]-2-thiobarbituric acid

SS-47

3-Ethyl-5-{[(ethylbenzothiazolin-2-ylidene)-methyl]-[(1,5-dimethylnaphtho[1,2-d]selenazolin-2-ylidene)methyl] methylene}rhodanine

SS-48

5-{Bis[(3-ethyl-5,6-dimethylbenzothiazolin-2-ylidene) methyl]methylene}-1,3-diethyl-barbituric acid

SS-49

3-Ethyl-5-{[(3-ethyl-5-methylbenzotellurazolin-2-ylidene) methyl][1-ethylnaphtho[1,2-d]-tellurazolin-2-ylidene) methyl]methylene}rhodanine

SS-50

Anhydro-5,5'-diphenyl-3,3'-di-(3-sulfopropyl)thiacyanine hydroxide, triethylammonium salt

SS-51

Anhydro-5-chloro-5'-phenyl-3,3'-di-(3-sulfopropyl) thiacyanine hydroxide, triethylammonium salt Kofron et al U.S. Pat. No. 4,439,520 is here incorporated by reference for its extensive listing of blue spectral sensitizing dyes. Similar dye structures, modified only by the addition or deletion of a two methine linking groups between the nuclei, can be used in the blue, green and red regions of the spectrum. For example, for the most part blue absorbing spectral sensitizing dyes are most commonly simple cyanines, having a single methine (e.g. —CH=) linkage between the nuclei; green absorbing spectral sensitizing dyes are commonly carbocyanines, having three methine linking groups between the nuclei; and red absorbing spectral sensitizing dyes are commonly dicarbocyanines, having five methine linking groups between the nuclei.

The silver halide emulsions in the Blue, Green and Red Recording Layer Units contain blue, green and red absorbing spectral sensitizing dyes, respectively, adsorbed to the surfaces of the grains. To the extent that emulsions of the Blue Recording Layer Unit contain significant levels of iodide, the iodide can be relied upon to impart blue light absorption. However, even in the Blue Recording Layer Unit, the incorporation of a blue spectral sensitizing dye is contemplated for enhanced sensitivity. Green and red absorbing spectral sensitizing dyes are essential in the Green and Red Recording Layer Units, respectively.

It is contemplated to incorporate in the photographic elements of the invention a dye-forming coupler in each layer unit. The hue of the dye formed can be independent of the wavelength of the light absorbed by the layer unit upon exposure. When the object is to reproduce the color of the image photographed, the blue, green and red recording layer units are contemplated to contain yellow, magenta and cyan dye-forming couplers, respectively. The dye image providing materials can be incorporated directly within the emulsion layer(s) or coated in a separate layer in reactive association (e.g., in contact) with the emulsion layer(s). Conventional dye image formers and modifying addenda are disclosed by the following:

Item 36544

X. Dye image formers and modifiers

Dye-forming couplers represent a specifically preferred class of dye image providing materials and are disclosed by the following:

Item 36544

X. Dye image formers and modifiers

B. Image-dye-forming couplers

Item 37038

II. Couplers

Ikenoue U.S. Pat. No. 5,254,446

Item 37038, Section II, paragraph E additionally discloses masking couplers, typically incorporated in color negative elements. Additional specific illustrations of dye-forming couplers are found in Szajewski U.S. Pat. No. 5,310,635, House et al U.S. Pat. No. 5,320,938, Szajewski et al U.S. Pat. No. 5,356,674, and Budz et al U.S. Pat. No. 5,451,490, the disclosures of which are incorporated by reference.

The layer units can contain a variety of additional addenda, such as illustrated by the following:

Item 36544

VII. Antifoggants and stabilizers

X. Dye image formers and modifiers

C. Image dye modifiers

D. Hue modifiers/stabilization

Item 37038

III. BARCs, Nucleating Agents, ETAs, Anti-foggants, Scavengers

IV. Color Fog Inhibitors

V. Discoloration Inhibitors

VI. Polymeric Addenda

VII. Structures of Stabilizers and Scavengers

VIII. Dispersions

IX. Solvents

XIV. DI(A)RS

In a preferred construction the Layer Units each contain a development inhibitor releasing (DIR) compound, which is typically a coupler. When the DIR compound releases an inhibitor moiety having a free valence capable of bonding to silver (e.g., containing an organic moiety terminating in $-S^-$), the concentration of the DIR is limited to less than $3\times10^{-3}$ (preferably $<1\times10^{-3}$) per mole of silver in the Layer Unit. When the DIR is a dye-forming coupler, the dye formed can correspond in hue to the dye image produced on development. Alternatively, the dye formed can be used to perform a masking or other color modifying function. The moiety released by the DIR can, as released, be directly available to serve a useful imaging function or can be initially blocked, requiring interaction with another agent, such as an electron transfer agent, to become actively available for performing its intended imaging function. It is specifically contemplated to employ DIR compounds in combination with bleach accelerator releasing compounds (BARCs).

The Protective Overcoat, the Layer Units, the Interlayers and the Undercoat all employ processing solution permeable vehicles. Conventional vehicle and vehicle related materials are disclosed in the following:

Item 36544
- II. Vehicles, vehicle extenders, vehicle-like addenda and vehicle related addenda
  - A. gelatin and hydrophilic colloid peptizers
  - B. Hardeners
  - C. Other vehicle components Item 37038
- XII. Hardeners To facilitate coating, all of the coated layers additionally usually also contain at least some surfactant. Conventional surfactants are illustrated by the following:

Item 36544
- IX. Physical property modifying addenda
  - A. Coating aids

Item 37038
- XI. Surfactants

The Protective Overcoat particularly typically additionally contains the following types of materials:

Item 36544
- IX. Coating physical property modifying addenda
  - B. Plasticizers and lubricants
  - C. Antistats
  - D. Matting agents Item 37038
- X. UV Stabilizers Antistats and matting agents can be present in other coated layers, but are usually associated with an outmost layer of the color recording photographic elements.

The Interlayers contain oxidized developing agent scavengers to prevent color developing agent oxidized in one layer unit from forming an image dye in an adjacent layer unit. Illustrations of interlayer scavengers are included in the following:

Item 37038
- III. BARCs, Nucleating Agents, ETAs, Anti-foggants, Scavengers
- VII. Structures of Stabilizers and Scavengers Any one of the Interlayers and the Undercoat can additionally contain processing solution decolorizable absorbing materials to control direct exposure of the underlying layer units or reflection reexposure (halation) of the overlying layer units. Carey Lea (yellow colloidal) silver or yellow filter dye is commonly used to protect red and green recording layer units that contain an emulsion having significant native blue sensitivity from unwanted blue exposure. When high chloride emulsions are employed in the layer units, blue absorbing filter dyes can be entirely eliminated, since silver chloride has little native blue sensitivity. The Undercoat is a preferred location for antihalation dyes. Processing solution decolorizable antihalation dyes and their use are illustrated by the following:

Item 36544
- VIII. Absorbing and scattering materials
  - B. Absorbing materials
  - C. Discharge Item 37038
- XIII. Filter and Absorber Dyes The Transparent Film Support can take any convenient conventional form. Conventional transparent photographic film supports are illustrated by the following:

Item 36544
- X. Supports

It is not necessary that any coating be present on the back side (the side opposite the layer units) of the support. In the Color Recording Element a Pelloid is shown to be present. The Pelloid can be coated using the same types of vehicles used to form the coated layers previously described. The Pelloid can be provided to act as an anticurl layer, at least partially offsetting the forces exerted on the front side of the Support by the other coated layers. The Pelloid also represents a second preferred location for antihalation dyes of the type described above. For example, with antihalation dye located in the Pelloid, it is possible to entirely dispense with the Undercoat and still realize high levels of image sharpness. This is because the largest mismatch in refractive indices encountered by exposing light and hence the highest reflection occurs at the interface of the Support and air on the back side of the support. Antistatic addenda, noted above in connection with the Protective Overcoat, can be additionally or alternatively located in the Pelloid.

The Magnetic Imaging Layer is an optional, but preferred layer having as its purpose to store information about the photographic element for use in exposure or subsequent processing. Magnetic imaging layers are illustrated by the following:

Item 36544
- XIV. Scan facilitating features Paragraph (2)

James U.S. Pat. No. 5,254,441 and 5,254,449

When image information is intended to be read from the photographic elements of the invention by reflection and/or transmission scanning, it is entirely feasible, but no longer of any importance, to form an image that is pleasing to the eye, as in color reversal films, or to form a negative image that can be exposed through to obtain a visually pleasing positive image, as in most color negative films. It is merely necessary that the 1st, 2nd and 3rd Layers Units when exposed and processed contain a retrievable record of the subject, including its color. False color records are just as useful for this purpose as natural color records, and it is, in fact, possible to form three retrievable color records without actually forming three dye images. Color negative films intended solely for scanning do not require masking couplers. Bohan U.S. Pat. No. 5,434,038 discloses a color negative film containing a masking coupler that is equally suited for image retrieval by printing or scanning. Color recording photographic element constructions specifically adapted for the scan retrieval of image information are illustrated by the following:

Item 36544
- XIV. Scan facilitating features Paragraph (1)

In addition, the disclosures of the following more recently issued patents of color recording photographic element constructions particularly adapted for scan image retrieval are here incorporated by reference: Sutton et al U.S. Pat.

Nos. 5,300,413 and 5,334,469, Sutton U.S. Pat. Nos. 5,314,794 and 5,389,506, Evans et al U.S. Pat. No. 5,389,503, Simons et al U.S. Pat. No. 5,391,443, Simons U.S. Pat. No. 5,418,119 and Gasper et al U.S. Pat. No. 5,420,003.

In addition it has been a long standing practice in the art to modify an edge of color recording film to provide an information record entirely separate from the color image record. For example, edge sound tracks are frequently provided on motion picture films. Modified edge region constructions are illustrated by the following:

Item 36544

XIV. Scan facilitating features Paragraph (3)

In the foregoing discussion the color recording photographic elements have been discussed by reference to 1st, 2nd and 3rd Layer Units each containing a single silver halide emulsion contained in a single layer. In fact, it is quite common to prepare emulsion layers by blending emulsions to realize photographic aim properties. It is also quite common to coat two or three emulsions differing in photographic speed in a single layer unit. By coating a faster emulsion as a separate layer over (closer to the source of exposing radiation) than a slower emulsion, a higher speed is realized than when the two emulsions are blended. Additionally, when the faster emulsion layer contains less than a stoichiometrically indicated amount of the dye image providing component (e.g., the faster emulsion layer is dye-forming coupler starved), not only is faster speed realized than by blending, but granularity can be lower than predicted from emulsion blending. When the layer order is reversed, a higher contrast is realized than when the two emulsions are blended. Variations of emulsion blending and layer arrangements within a single emulsion layer unit are illustrated by the following:

Item 36544

I. Emulsion grains and their preparation

E. Blends, layers and performance categories

As an alternative to constructing a color recording photographic element with single blue, green and red recording layer units, it is common practice to provide two or even three layer units for recording in the same region of the spectrum. The most common reason for these constructions is to allow the fastest emulsion for recording in a particular region of the spectrum to receive exposing light prior to transmission through the slower emulsion layers of other layer units. This increases speed and image sharpness. Color recording photographic elements having varied arrangements of layer units, including at least two separate layer units for recording exposure to the same region of the spectrum are illustrated by the following:

Item 36544

XI. Layers and layer arrangements

The following are illustrative of only a few of the many possible additional layer unit sequences including at least two layer units for recording exposures to the same region of the spectrum:

SQ-7 |B|Gf|Rf|Gs|Rs| S |,

SQ-8 |Bf|Gf|Rf|Bs|Gs|Rs| S |,

SQ-9 |B|Gf|Rf|Gm|Rm|Gs|Rs| S |,

SQ-10 |Gf|Rf|Bf|Gs|Rs|Bs| S |,

SQ-11 |Gf|Rf|Bf|Gm|Rm|Bm|Gs|Rs|Bs| S |, and

-continued

SQ-12 |Rf|B|Gf|Rf|Gs|Rs| S | where

B, G, R and S are as defined above, f=higher or highest speed of layer units recording in the same region of the spectrum, m=intermediate speed of layer units recording in the same region of the spectrum, s=slower or slowest speed of layer units recording in the same region of the spectrum.

In SQ-12 two Rf layer units are shown. The Rf layer unit farthest from the support contains a much lower silver halide coating coverage than the remaining Rf layer unit and is sometimes referred to as a skim coat. Its function is offer a small speed boost to the red record to compensate for the otherwise less favorable for speed and sharpness locations of the red recording layer units as compared to the green recording layer units.

More specific illustrations of color recording layer units that can be readily modified by the inclusion of one or more high chloride {100} tabular grain emulsions are provided by the following:

Item 37038

XIX. Color Negative Example 1

XX. Color Negative Example 2

XXI. Color Reversal Example 1

XXII. Color Reversal Example 2

Color recording photographic elements are typically employed to record exposures over the full range of the visible spectrum. Occasionally color recording photographic elements are employed to record also exposures in the near ultraviolet and/or near infrared portions of the spectrum. When this is undertaken, an additional layer unit can be provided for this purpose. Any convenient conventional technique for imagewise exposing and subsequently processing the color recording photographic elements of the invention is contemplated. Typical convenient conventional techniques are illustrated by the following:

Item 36544

XVI. Exposure

XVII. Chemical development systems

A. Non-specific processing features

B. Color-specific processing features

XIX. Development

A. Developing Agents

B. Preservatives

C. Antifoggants

D. Sequestering Agents

E. Other additives

XX. Desilvering, washing, rinsing and stabilizing

A. Bleaching

B. Fixing

C. Bleach-Fixing

D. Washing, rinsing and stabilizing

Item 37038

XXIII. Exposure and processing

B. Color Film Processing

Koboshi U.S. Pat. No. 4,814,260

Southby U.S. Pat. No. 5,302,498

Kobayashi U.S. Pat. No. 5,354,646

Szajewski et al U.S. Pat. No. 5,356,764

Szajewski et al U.S. Pat. No. 5,443,943

The disclosures of each of the five U.S. Patents cited immediately above are here incorporated by reference. Szajewski et al, both citations, specifically disclose exposure and processing of high chloride tabular grain emulsion containing color recording photographic elements.

Exposure of camera speed color recording photographic elements in limited use and recyclable cameras is specifically contemplated. Limited use camera and incorporated film constructions are the specific subject matter of Item 36544, Section XVI Exposure, cited above, paragraph (2), and Sowinski et al U.S. Pat. No. 5,466,560, the disclosure which is here incorporated by reference. Spooled films containing high chloride tabular grain emulsions are specifically disclosed in Szajewski U.S. Pat. No. 5,310,635, the disclosure of which is here incorporated by reference.

Although *Research Disclosure*, Items 36544 and 37038, have been used to provide specific illustrations of conventional color recording photographic elements, their components, exposure and processing, it is recognized that numerous other publications also disclose conventional features, including the following:

James *The Theory of the Photographic Process,* 4th Ed., Macmillan, New York, 1977;

*The Kirk-Othmer Encyclopedia of Chemical Technology*, John Wiley and Sons, New York, 1993;

Neblette's *Imaging Processes and Materials*, Van Nostrand Reinhold, New York 1988; and Keller, *Science and Technology of Photography*, VCH, New York, 1993.

EXAMPLES

The suffix E is employed to designate embodiments that satisfy invention requirements while the suffix C is employed to designate other embodiments included for purposes of comparison. Each emulsion was optimally sensitized by the customary empirical technique of varying the level of spectral sensitizing dye, the levels of sulfur and gold sensitizers, and the hold time at elevated temperature (often referred to as the digestion time) of test samples.

Example 1

This example demonstrates the sensitivity advantages of the photographic elements of the invention as compared to those substituting (a) a high chloride {100} tabular grain emulsion of smaller mean ECD than contemplated by the invention or (b) high speed AgIBr {111} tabular grain emulsions of varied mean ECD's.

Emulsion 1E

This demonstrates the preparation and sensitization of an AgICl {100} tabular grain emulsion having a mean grain ECD of 4.7 μm and a mean grain thickness of 0.2 μm.

An 18 L reactor charged with 4370.5 g of distilled water containing 3 g of NaCl, 195 g of oxidized gelatin, and 0.86 mL of a polyethylene glycol dialkyl ester antifoamant, was adjusted to pH 5.7 at 35° C. The contents of the reactor were stirred vigorously throughout the precipitation process. To the initially introduced solution were added simultaneously 1M $AgNO_3$ and 4M NaCl solutions, at a rate of 78 mL/min and 20.1 mL/min, respectively, for 1.60 minutes. The pCl was maintained at 1.97 during nucleation.

A solution containing 9267 g distilled water, 2.25 g NaCl, and 0.48 g KI was then added. The solution was allowed to stand for 5 minutes. After the hold, the mixture temperature was ramped from 35° C. to 36.5° C. in 2 minutes, and, during the same time interval, 4M $AgNO_3$ (containing 0.08 mg mercuric chloride per mole of $AgNO_3$) and 4M NaCl solutions were added at 15 mL/min each, with pCl ramped from 2.19 to 2.35. The temperature was further ramped from 36.5° C. to 50° C. in 18 minutes, during which period the $AgNO_3$ and NaCl solutions were added at 15 mL/min, with pCl shifting from 2.35 to 2.21. The temperature was further ramped from 50° C. to 70° C. in 20 minutes, during which period the $AgNO_3$ and NaCl solutions were added at linearly accelerated rates of from 15.0 to 22.5 mL/min and the pCl shifted from 2.21 to 1.72. After the ramp, the medium was allowed to stand at 70° C. for 15 minutes. After the hold, addition of the $AgNO_3$ and NaCl solutions was resumed at linearly accelerated rates from 15 to 40.3 mL/min in 42.2 minutes. The pCl of the emulsion was held at 1.72 during this growth period. Then the reactor was allowed to stand at 70° C. with vigorous stirring for another 30 minutes.

After the hold, a 100 mL solution containing 6.70 g of KI was added, and the emulsion was allowed to stand for 10 minutes. Final grain growth was completed in two steps: first by adding 4M $AgNO_3$ containing 0.08 mg mercuric chloride per mole of silver nitrate and 4M NaCl containing 1.10 g/L $K_4Ru(CN)_6$ at 15.0 mL/min for 4.0 minutes, then by adding 4M $AgNO_3$ containing 0.08 mg mercuric chloride per mole of silver nitrate and 4M NaCl solutions at 15.0 mL/min for 5.33 minutes. The pCl of the reactor contents was maintained at 1.72 during these two final steps.

The temperature of the reactor was then lowered to 40° C. and pCl was adjusted to 1.54. The emulsion was washed and concentrated using ultrafiltration. Low methionine gelatin in the amount of 218.0 g was added, and the pCl was adjusted to 1.54 with a sodium chloride solution.

The resultant emulsion was a high chloride {100} tabular grain emulsion with an average equivalent circular diameter of 4.7 μm and a mean grain thickness of 0.20 μm. The {100} tabular grains accounted for greater than 70 percent of total grain projected area and exhibited clearly lower thicknesses than the remaining grains.

Optimum sensitization was achieved using the following procedure: the emulsion was spectrally sensitized to green light using spectral sensitizing dye SS-21 at 0.531 mmole dye/Ag mole and dye SS-27 at 0.089 mmole dye/Ag mole. The dyes were added separately with a 15 minute hold between additions. This was followed by the addition of sodium thiosulfate pentahydrate at 2.0 mg/Ag mole and potassium tetrachloroaurate at 1.0 mg/Ag mole. The temperature of the well stirred mixture was then raised to 62.5° C. over 13.5 minutes and held at 62.5° C. for 18 minutes. The emulsion was then cooled to 40° C. as quickly as possible, 70 mg/Ag mole of 1-(3-acetamidophenyl)-5-mercaptotetrazole (APMT) were then added, and the emulsion was chill set.

Emulsion 2E

This demonstrates the preparation and sensitization of a high chloride {100} tabular grain emulsion having a mean grain ECD of 3.0 μm and a mean grain thickness of 0.14 μm.

A 180 L reactor charged with 43.26 Kg of distilled water containing 29.70 g of NaCl, 1930.5 g of oxidized gelatin, and 9.01 mL of a polyethylene glycol dialkyl ester antifoamant was adjusted to pH 5.7 at 35° C. The contents of the reactor were stirred vigorously throughout the precipitation process. To the initially introduced solution were added simultaneously 1M $AgNO_3$ and 4M NaCl solutions, at a rate of 772.2 mL/min and 198.8 mL/min, respectively, for 1.68 minutes. The pCl was maintained at 1.98 during nucleation.

A solution containing 108.8 Kg of distilled water, 26.37 g of NaCl, and 6.65 g of KI was then added. The solution was held for 5 minutes. After the hold, the mixture temperature was ramped from 35° C. to 36.5° C. in 2.0 minutes, and, during the same time interval, 4M $AgNO_3$ (containing 0.08 mg mercuric chloride per mole of silver nitrate) and 4M NaCl solutions were added at 148.5 mL/min and 130.8 mL/min respectively, with pCl being ramped from 2.21 to 2.35. The temperature was further ramped from 36.5° C. to 50° C. in 18 minutes, and during this time the $AgNO_3$ and NaCl solutions were added at 148.5 mL/min and 153.4 mL/min, respectively, with pCl ending at 2.21. The temperature was further ramped from 50° C. to 70° C. in 20 minutes, and, during this time interval, the $AgNO_3$ solution was added at a linearly accelerated rate of from 148.5 to 222.7 mL/min and the NaCl solution was added at a linearly deaccelerated rate of from 225.5 mL/min to 202.6 mL/min, while the pCl was allowed to shift from 2.21 to 1.72. After this segment the solution was held for 15 minutes. After the hold the addition of the solutions was resumed at linearly accelerated rates from 148.5 mL/min to 357.6 mL/min for the $AgNO_3$ solution and 153.4 mL/min to 365.1 mL/min for the NaCl solution, while the pCl was maintained at 1.72. The reactor contents were allowed to stand at 70° C. with vigorous stirring for another 20 minutes.

After the hold, 700 mL of a solution containing 66.40 g of KI were added, and the emulsion was allowed to stand for 5.0 minutes. Final grain growth was completed by adding 4M $AgNO_3$ (containing 0.08 mg mercuric chloride per mole of silver nitrate) and 4M NaCl solutions at rates of 357.6 mL/min and 362.6 mL/min, respectively, for 3.90 minutes, with pCl being maintained at 1.72.

The temperature of the reactor was then lowered to 40° C., pCl was adjusted to 1.35, and the emulsion was washed and concentrated using ultrafiltration. A low methionine gelatin in the amount of 1259.0 g was added, and the pCl was adjusted to 1.54 with a sodium chloride solution.

The resultant emulsion was a high chloride {100} tabular grain emulsion having a mean ECD of 3.0 μm and a mean grain thickness of 0.14 μm. High chloride {100} tabular grains accounted for greater than 70 percent of total grain projected area.

Optimum sensitization was achieved using the following procedure: the emulsion was spectrally sensitized to green light using spectral sensitizing dyes SS-21 at 0.46 mmole dye/Ag mole and SS-27 at 0.077 mmole dye/Ag mole. The dyes were added separately with a 15 minute hold between additions. This was followed by the addition of sodium thiosulfate pentahydrate at 2.0 mg/Ag mole and potassium tetrachloroaurate at 1.0 mg/Ag mole. The temperature of the well stirred mixture was then raised to 62.5° C. over 13.5 minutes and held at 62.5° C. for 20 minutes. The emulsion was then cooled to 40° C. as quickly as possible, and 70 mg/Ag mole of APMT was then added and the emulsion was chill set.

Emulsion 3C

This demonstrates the preparation and sensitization of a high chloride {100} tabular grain emulsion having a mean ECD of 1.4 μm and a mean grain thickness of 0.16 μm.

A 180 L reactor was charged with 43.475 Kg of distilled water containing 7.36 g of NaCl, 1584.0 g of oxidized gelatin, and 9.0 mL of a polyethylene glycol dialkyl ester antifoamant. The contents of the reactor were stirred vigorously throughout the precipitation process. The reactor contents were brought to 40° C. A solution of 1256.6 g of distilled water and 4.18 g of KI was added to the reactor vessel, and the contents were held for 5 minutes. The pCl of the kettle was 2.53 at 40° C. To the initially introduced solutions were added simultaneously 1.25M $AgNO_3$ (containing 0.064 mg mercuric chloride per mole of silver nitrate) (Ag–1) and 1.25M NaCl (NaCl–1) at a flow rate of 2800 mL/min each, for 0.5 minutes. The medium was allowed to stand for 1.25 minutes.

After the hold, addition of Ag–1 and NaCl–1 continued for 30.0 minutes at 176.4 mL/min and 287 mL/min, respectively, and the NaCl–1 solution was used to maintain the pCl of the reactor at 2.31 at 40° C. Then the Ag–1 and NaCl–1 solutions were added at linearly accelerated rates of from 176.4 to 388.8 mL/min and from 280.5 to 419.9 mL/min, respectively, over 125 minutes, while maintaining the pCl of the reactor at 2.31.

The reactor pCl was adjusted to 1.52 using NaCl–1 added at 560 mL/min over 7.5 minutes. Then the reactor was allowed to stand at 40° C. with vigorous stirring for 10 minutes. After this time, Ag–1 solution was added to the reactor at 140 mL/min for 30 minutes, and the pCl was allowed to shift to 2.34. Then a solution containing 436.9 g distilled water and 37.18 g KI was added to the reactor, and the reactor contents were held for 20 minutes.

The precipitation was completed by adding Ag–1 and NaCl–1 at 389.0 mL/min and 407.0 mL/min for 10 minutes, while maintaining the pCl at 2.31. A solution containing 292.2 g NaCl and 4900 g distilled water was added to the reactor contents, and the emulsion was washed and concentrated using ultrafiltration. A low methionine gelatin in the amount of 105.0 g was added, and the pCl was adjusted to 1.54 with a sodium chloride solution.

The resultant emulsion was a high chloride {100} tabular grain emulsion having a mean ECD of 1.4 μm and a mean grain thickness of 0.16 μm. High chloride {100} tabular grains accounted for greater than 70 percent of total grain projected area.

Optimum sensitization was achieved using the following procedure: the emulsion was spectrally sensitized to green light using spectral sensitizing dyes SS-21 and SS-27 each at 0.086 mmole dye/Ag mole. The dyes were added separately with a 15 minute hold between additions. This was followed by the addition of sodium thiosulfate pentahydrate at 2.0 mg/Ag mole and potassium tetrachloroaurate at 1.0 mg/Ag mole. The temperature of the well stirred mixture was then raised to 60° C. over 12 minutes and held at 60° C. for 25 minutes. The emulsion was then cooled to 40° C. as quickly as possible, 70 mg/Ag mole of APMT were then added, and the emulsion was chill set.

Emulsion 4C

This demonstrates the preparation and sensitization of a silver iodobromide {111} tabular grain emulsion having a mean ECD of 5.8 μm and a mean grain thickness of 0.13 μm.

A reactor at 75° C. was charged with 4945.6 g distilled water, 30.0 g NaBr, 10.0 g oxidized gelatin, and 1.30 mL of polyethylene glycol dialkyl esters antifoamant. To the reactor were added by double-jet addition 64 mL/min of 0.4M $AgNO_3$ and 15.3 mL/min of 2.0M NaBr for 1 minute, followed by a 1 minute hold. This was followed by the addition 350 mL of 0.124M $(NH_4)_2SO_4$ and another 1 minute hold. This was followed by the addition of 40 mL of 2.5M NaOH and a 5 minute hold. This was followed by the addition of 25 mL of 4M $HNO_3$ and a 1 minute hold.

To the reactor was added a solution containing 140.14 g oxidized gelatin, 1702.8 g distilled water, and 0.45 mL of polyethylene glycol dialkyl ester antifoamant, followed by a 5 minute hold. By double-jet over a 5 minute interval were added 0.4M $AgNO_3$ at 87.0 mL/min and a solution containing 2.7085M NaBr and 0.04125M KI (X-A) at 17.9 mL/min at a constant pBr of 1.36. By double-jet over a 25 minute interval were added 2.75M $AgNO_3$ (Ag-A) at a linearly accelerated flow rate of from 15.0 mL/min to 40 mL/min, and X-A at a linearly accelerated flowrate of from 16.5 mL/min to 42.3 mL/min at a constant pBr of 1.36. By double-jet over an interval of 33 minutes were added Ag-A at a linearly accelerated flowrate of from 40 mL/min to 101.8 mL/min and X-A at a linearly accelerated flowrate from 42.4 mL/min to 106.7 mL/min at a constant pBr of 1.36, followed by a 1 minute hold. This was followed by the addition of 1.2M KI at 75 mL/min for 2 minutes, and, thereafter, the addition of 2M NaBr at 20 mL/min for 0.5 minute. The double-jet addition of Ag-A at 50 mL/min and a 2M NaBr solution for 24 minutes was conducted at a pBr 2.29.

The emulsion was cooled to 40° C. and washed to a pBr 3.56, then concentrated using ultrafiltration. Gelatin was added up to the amount of 60 g/Ag mole, and the emulsion was chill set and stored.

The resultant silver iodobromide {111} tabular grain emulsion exhibited a mean ECD of 5.8 μm and a mean grain thickness of 0.13 μm, with tabular grains accounting for greater than 70 percent of total grain projected area.

The resultant emulsion was optimally sensitized using the following procedure: The emulsion was melted at 40° C., and NaSCN was added at 100 mg/mole. The emulsion was spectrally sensitized to green light using spectral sensitizing dyes SS-21 at 0.53 mmole dye/Ag mole and SS-28 at 0.17 mmole dye/Ag mole. The dyes were added separately with a 20 minute hold between additions. This was followed by the addition of gold sensitizer in the form of sodium aurous (I) dithiosulfate dihydrate at 1.8 mg/mole of silver, and sulfur sensitizer in the form of sodium thiosulfate pentahydrate at 0.90 mg/Ag mole. A finish modifier, benzothiazolium tetrafluoroborate, was added at 35 mg/Ag mole.

The temperature of the well stirred mixture was then raised to 60° C. over 12 minutes and held at 60° C. for 20 minutes. The emulsion was then cooled and chill set as quickly as possible.

Emulsion 5C

This demonstrates the preparation and sensitization of a silver iodobromide {111} tabular grain emulsion having a mean ECD of 3.7 μm and a mean grain thickness of 0.13 μm.

A reactor at 75° C. was charged with 4958 g distilled water, 30.0 g NaBr, 10.0 g gelatin, and 0.65 mL of polyethylene glycol dialkyl ester antifoamant. To the reactor were added by double-jet addition 64 mL/min of 0.393M $AgNO_3$ and 20 mL/min of 2.0M NaBr for 1 minute, followed by a 1 minute hold. This was followed by the addition of 30 mL of 3M $NH_4OH$ over an interval of 2.5 minutes. This was followed by the addition of 25 mL of 4M $HNO_3$ and a 1 minute hold.

To the reactor was added a solution containing 140.1 g gelatin, 16 g NaBr, 1703 g distilled water, and 0.25 mL of polyethylene glycol dialkyl ester antifoamant. This was followed by a 5 minute hold. By double-jet over a 3 minute interval were added 0.393M $AgNO_3$ at 87.6 mL/min and salt solution X-A at 13.3 mL/min at a constant pBr of 1.23. By double-jet over a 25 minute interval were added Ag-A at a linearly accelerated flow rate of from 15.0 mL/min to 40 mL/min, and X-A at a linearly accelerated flowrate of from 16.0 mL/min to 41.7 mL/min at a constant pBr of 1.23. By double-jet over an interval of 31 minutes were added Ag-A at a linearly accelerated flowrate of from 40 mL/min to 102 mL/min and X-A at a linearly accelerated flow rate of from 41.8 mL/min to 105.8 mL/min at a constant pBr of 1.23. This was followed by the double-jet addition over a 1.5 minute interval of Ag-A and 100 mL/min and X-A at 104.3 mL/min, and, through an additional jet, 50 mL of water containing $K_2IrCl_6$ at 3.075 mg/L, added over one minute. The pBr of the reactor was maintained at 1.23 during these additions. Then, 250.4 mL of a solution containing 9.82 mg KSeCN/L were added to the reactor, followed by a 2 minute hold. A solution containing 194.8 g NaBr and 664.7 g distilled water was added to the reactor, followed by a 2 minute hold. Then AgI Lippmann grains in the amount of 0.246 mole were added to the reactor, followed by a 2 minute hold. Then double-jet addition for 24.6 minutes was conducted using Ag-A at 50 mL/min and a 2M NaBr solution as required to maintain a pBr of 2.29.

The emulsion was cooled to 40° C. and washed to a pBr 3.56, then concentrated using ultrafiltration. gelatin in the amount of 60 g/Ag mole was added, and the emulsion was chill set and stored.

The resultant silver iodobromide {111} tabular grain emulsion exhibited a mean ECD of 3.7 μm and a mean grain thickness of 0.13 μm, with tabular grains accounting for greater than 70 percent of total grain projected area.

The resultant emulsion was optimally sensitized using the following procedure: The emulsion was melted at 43° C., and NaSCN was added at 136 mg/mole, and benzothiazolium tetrafluoroborate was added as a finish modifier at 31 mg/mole. The emulsion was spectrally sensitized to green light using spectral sensitizing dyes SS-21 at 0.61 mmole/Ag mole and SS-27 at 0.10 mmole dye/Ag mole. The dyes were added separately with a 20 minute hold between additions. This was followed by the addition of gold sensitizer in the form of sodium aurous (I) dithiosulfate dihydrate at 1.92 mg/Ag mole, and sulfur sensitizer in the form of sodium thiosulfate pentahydrate at 0.96 mg/Ag mole.

The temperature of the well stirred mixture was then raised to 63.9° C. over 12.3 minutes and held at 63.9° C. for 5 minutes. The emulsion was then cooled to 43.3° C. over 18.5 minutes, and 0.5 g/Ag mole of 4-hydroxy-6-methyl-1,3,3a,7-tetraazaindene (TAI) was added. The emulsion was then chill set.

Emulsion 6C

This demonstrates the preparation and sensitization of a silver iodobromide {111} tabular grain emulsion having a mean ECD of 2.17 μm and a mean grain thickness of 0.13 μm.

A reactor at 57° C. was charged with 4958 g distilled water, 30.0 g NaBr, 10.0 g gelatin, and 0.65 mL of polyethylene glycol dialkyl ester antifoamant. To the reactor were added by double-jet addition 64 mL/min of 0.393M $AgNO_3$ and 20 mL/min of 2.0M NaBr for 1 minute, followed by a 1 minute hold. This was followed by the addition of 30 mL of 3M $NH_4OH$, followed by a hold of 2.5 minutes. This was followed by the addition of 25 mL of 4M $HNO_3$ and a 1 minute hold.

To the reactor was added a solution containing 140.1 g gelatin, 1703 g distilled water, and 0.25 mL of polyethylene glycol dialkyl ester antifoamant, followed by a 5 minute hold. By double-jet over a 3 minute interval were added 0.393M $AgNO_3$ at 87.6 mL/min and salt solution X-A at 13.3 mL/min at a constant pBr of 1.41. By double-jet over a 25 minute interval were added Ag-A at a linearly accelerated flow rate of from 15.0 mL/min to 40 mL/min and X-A at a linearly accelerated flowrate of from 16.0 mL/min to 41.7 mL/min at a constant pBr of 1.41. By double-jet over an interval of 31 minutes were added Ag-A at a linearly accelerated flowrate of from 40 mL/min to 102 mL/min and X-A at a linearly accelerated flow rate of from 41.8 mL/min to 105.8 mL/min at a constant pBr of 1.41. This was followed by the double-jet addition over a 1.5 minute interval of Ag-A and 100 mL/min and X-A at 104.3 mL/min, and, through an additional jet, 50 mL of water containing $K_2IrCl_6$ at 3.075 mg/L, added over one minute. The pBr of the reactor was maintained at 1.41 during these additions. Then, 250.4 mL of a solution containing 9.82 mg KSeCN/L were added, followed by a 2 minute hold. A solution containing 194.8 g NaBr and 664.7 g distilled water was added to the reactor, followed by a 2 minute hold. Then AgI Lippmann grains in the amount of 0.396 mole were added to the reactor, followed by a 2 minute hold. Then double-jet addition for 24.6 minutes was conducted using Ag-A at 50 mL/min and a 2M NaBr solution as required to maintain a pBr of 2.49.

The emulsion was cooled to 40° C. and washed to a pBr 3.56, then concentrated using ultrafiltration. Gelatin was added up to the amount of 60 g/Ag mole, and the emulsion was chill set and stored.

The resultant silver iodobromide {111} tabular grain emulsion exhibited a mean ECD of 2.17 μm and a mean grain thickness of 0.13 μm, with tabular grains accounting for greater than 70 percent of total grain projected area.

The resultant emulsion was optimally sensitized using the following procedure: The emulsion was melted at 43° C., and NaSCN was added at 100 mg/mole, and benzothiazolium tetrafluoroborate was added as a finish modifier at 35 mg/Ag mole. The emulsion was spectrally sensitized to green light using spectral sensitizing dyes SS-21 at 0.56 mmole dye/Ag mole and SS-28 at 0.19 mmole dye/Ag mole. The dyes were added separately with a 20 minute hold between additions. This was followed by the addition of gold sensitizer in the form of sodium aurous (I) dithiosulfate dihydrate at 2.10 mg/Ag mole, and sulfur sensitizer in the form of sodium thiosulfate pentahydrate at 0.87 mg/Ag mole.

The temperature of the well stirred mixture was then raised to 60° C. over 10 minutes and held at 60° C. for 7 minutes. The emulsion was then cooled to 43.3° C. over 15 minutes, and 0.5 g/Ag mole of TAI was added. The emulsion was then chill set.

Emulsion 7C

This demonstrates the preparation and sensitization of a silver iodobromide {111} tabular grain emulsion having a mean ECD of 1.2 μm and a mean grain thickness of 0.12 μm.

A reactor at 52° C. was charged with 4958 g distilled water, 30.0 g NaBr, 10.0 g gelatin, and 0.65 mL of polyethylene glycol dialkyl ester antifoamant. To the reactor were added by double-jet addition 87.6 mL/min of 0.393M $AgNO_3$ and 20 mL/min of 2.0M NaBr for 3 minutes, followed by a 1 minute hold. This was followed by the addition of 120 mL of 3M $NH_4OH$, followed by a hold of 2.5 minutes. This was followed by the addition of 93 mL of 4M $HNO_3$, followed by a 1 minute hold.

To the reactor was added a solution containing 140.1 g gelatin, 1703 g distilled water, and 0.25 mL of polyethylene glycol dialkyl ester antifoamant, followed by a 5 minute hold. By double-jet over a 3 minute interval were added 0.393M $AgNO_3$ at 87.6 mL/min and salt solution X-A at 13.3 mL/min at a constant pBr of 1.23. By double-jet over a 25 minute interval were added Ag-A at a linearly accelerated flow rate of from 15.0 mL/min to 40 mL/min and X-A at a linearly accelerated flowrate of from 16.0 mL/min to 41.7 mL/min at a constant pBr of 1.23. By double-jet over an interval of 31 minutes were added Ag-A at a linearly accelerated flowrate of from 40 mL/min to 102 mL/min and X-A at a linearly accelerated flow rate of from 41.8 mL/min to 105.8 mL/min at a constant pBr of 1.23. This was followed by the double-jet addition over a 1.5 minute interval of Ag-A at 100 mL/min and X-A at 104.3 mL/min, and, through an additional jet, 50 mL of water containing $K_2IrCl_6$ at 12.3 mg/L, added over one minute. The pBr of the reactor was maintained at 1.41 during these additions. Then, 250.4 mL of a solution containing 9.82 mg KSeCN/L was added to the reactor, followed by a 2 minute hold. A solution containing 194.8 g NaBr and 664.7 g distilled water was added to the reactor, followed by a 2 minute hold. Then AgI Lippmann grains in the amount of 0.396 mole were added to the reactor, followed by 2 minute hold. Then double-jet addition for 24.6 minutes was conducted using Ag-A at 50 mL/min and a 2M NaBr solution as required to maintain a pBr of 2.29.

The emulsion was cooled to 40° C. and washed to a pBr 3.56, then concentrated using ultrafiltration. gelatin was added up to the amount of 60 g/Ag mole, and the emulsion was chill set and stored.

The resultant silver iodobromide {111} tabular grain emulsion exhibited a mean ECD of 1.2 μm and a mean grain thickness of 0.12 μm, with tabular grains accounting for greater than 70 percent of total grain projected area.

The resultant emulsion was optimally sensitized using the following procedure: The emulsion was melted at 43° C., NaSCN was added at 100 mg/Ag mole, and benzothiazolium tetrafluoroborate was added as a finish modifier at 35 mg/Ag mole. The emulsion was spectrally sensitized to green light using spectral sensitizing dyes SS-21 at 0.68 mmole dye/Ag mole and SS-28 at 0.22 mmole dye/Ag mole. The dyes were added separately with a 20 minute hold between additions. This was followed by the addition of gold sensitizer in the form of sodium aurous (I) dithiosulfate dihydrate at 2.10 mg/Ag mole, and sulfur sensitizer in the form of sodium thiosulfate pentahydrate at 0.87 mg/Ag mole.

The temperature of the well stirred mixture was then raised to 61.7° C. over 11 minutes and held at 61.7° C. for 5 minutes. The emulsion was then cooled to 43.3° C. over 16.5 minutes, and 0.5 g/Ag mole of TAI was added. The emulsion was then chill set.

Sensitometry

Each sensitized emulsion was coated on to a cellulose acetate film support having an antihalation layer coated on the back side of the film support and a 4.89 g/m$^2$ gelatin undercoat on the emulsion side of the support. The emulsion coating density was 1.08 g/m$^2$ of silver, with 0.97 g/m$^2$ of cyan dye-forming coupler C-1, 1.75 g/Ag-mole TAI, and 3.23 g/m$^2$ of gelatin. Each emulsion layer was overcoated with 4.31 g/m$^2$ of gelatin, and the entire coating was hardened with bis(vinylsulfonylmethyl)ether at 1.8% by weight, based total coated gelatin.

C-1

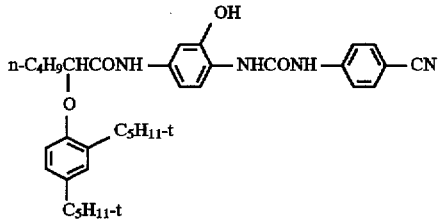

All coatings were exposed through a step wedge for 0.01 second with a 3000° K. tungsten light source filtered through a Daylight V and a Kodak Wratten™ 9 filter (transmission at wavelengths longer than 460 nm). The coatings were developed at 38° C. in the Reference Developer for 3 minutes and 15 seconds and then bleached, fixed and washed according to the color negative Kodak Flexicolor™ C-41 process. The Status M red density formed in each sample as a result of photographic processing was measured and the exposure required to produce a density of 0.15 above minimum density (Dmin) was determined for each sample.

The correlations between the emulsion type, mean ECD, sensitivity (S) and exposure to produce a density of 0.15 above Dmin (H) are set out in Table I.

TABLE I

| Emul. | Tabular Type | ECD/t (μm) | Dmin | S (1/H) | H (lux-sec.) |
|---|---|---|---|---|---|
| 1E | AgICl {100} | 4.7/0.20 | 0.215 | 1514 | $0.7 \times 10^{-3}$ |
| 2E | AgICl {100} | 3.0/0.14 | 0.241 | 776 | $1.3 \times 10^{-3}$ |
| 5C | AgIBr {111} | 3.7/0.13 | 0.164 | 708 | $1.4 \times 10^{-3}$ |
| 4C | AgIBr {111} | 5.8/0.13 | 0.163 | 589 | $1.7 \times 10^{-3}$ |
| 6C | AgIBr {111} | 2.2/0.13 | 0.231 | 457 | $2.2 \times 10^{-3}$ |
| 7C | AgIBr {111} | 1.2/0.12 | 0.195 | 251 | $4.0 \times 10^{-3}$ |
| 3C | AgICl {100} | 1.4/0.16 | 0.077 | 245 | $4.1 \times 10^{-3}$ |

In Table I the photographic elements are arranged in order of sensitivity. Notice that the least sensitive emulsion 3C, an AgICl {100} tabular grain emulsion, is actually slower than a somewhat smaller mean ECD AgIBr {111} tabular grain emulsion 7C. The speed relationship between emulsions 7C and 3C accords at least qualitatively with what is generally accepted by those skilled in the art. That is, when tabular grain emulsions of comparable mean ECD's are compared, AgIBr tabular grain emulsions exhibit higher sensitivities than those of other halide compositions.

In comparing AgIBr {111} tabular grain emulsions 4C, 5C, 6C and 7C, notice that sensitivity increases as mean ECD increases until the very largest mean ECD of 5.8 μm is reached. This last emulsion, which would be expected to be fastest of all emulsions prepared, based on its mean ECD, actually exhibits a sensitivity well below that of emulsion 5C, which exhibits a mean ECD of only 3.7 μm. This demonstrates the sensitivity roll-off effect described by Keller, discussed in the Background section of the specification.

The AgICl {100} tabular grain emulsions 1E, 2E and 3C show no roll-off with increasing mean ECD's. This was unexpected.

Additionally, notice that the AgICl {100} tabular grain emulsions 1E and 2E both demonstrate sensitivities higher than the highest attained sensitivity of the AgIBr {111} tabular grain emulsions. This also was unexpected. The relationship expected, at least qualitatively, is that shown between emulsions 7C and 3C. These emulsions provide no clue that there is the possibility of attaining with AgICl {100} tabular grain emulsions sensitivity levels that far exceed the highest sensitivity levels heretofore reported with AgIBr {111} tabular grain emulsions. By preparing and investigating the photographic properties of AgICl {100} tabular grain emulsion having mean ECD's in the range of from 3.0 to 6.0 μm, with thicknesses limited to 0.2 μm or less to insure that reasonable levels of image quality can be attained, a class of emulsions never before examined has been discovered to have higher levels of sensitivity than expected or considered possible.

Examining the invention from another perspective, it can be seen that the exposure H in lux-seconds required to produce a density of 0.15 above fog in a photographic element of the invention using the most sensitive AgICl {100} tabular grain emulsion is only half that required to obtain the same image density using the most sensitive AgIBr {111} tabular grain emulsion. This translates to a speed advantage for the most sensitive AgICl {100} tabular grain emulsion of 0.3 log E, where E is exposure in lux-seconds.

Example 2

This example compares the susceptibility of the emulsions of Example 1 to pressure desensitization. It is generally recognized that tabular grain emulsions show an increasing susceptibility to pressure desensitization as the mean ECD of the tabular grains increases.

Samples of the emulsions were coated, exposed and processed as described in Example 1, except that film samples of each emulsion were compared with and without a 68.95 MPa (10,000 psi) pressure applied using a smooth roller pressure tester after coating and before exposure. The pressure desensitization (ΔDp) was measured as the change in the midpoint density, (Dmax-Dmin)÷2+Dmin, with a loss of midpoint density attributable to the application of pressure being shown as a negative value. The midpoint densities of the unpressured samples are also provided as a point of reference. The results are summarized in Table II.

TABLE II

| Emul. | Tabular Type | ECD/t (μm) | Midpoint Density | ΔDp |
|---|---|---|---|---|
| 4C | AgIBr {111} | 5.8/0.13 | 0.953 | −0.218 |
| 1E | AgICl {100} | 4.7/0.20 | 1.068 | −0.066 |
| 5C | AgIBr {111} | 3.7/0.13 | 1.060 | −0.104 |
| 2E | AgICl {100} | 3.0/0.14 | 1.194 | −0.053 |
| 6C | AgIBr {111} | 2.2/0.13 | 1.342 | −0.016 |
| 3C | AgICl {100} | 1.4/0.16 | 1.351 | 0 |
| 7C | AgIBr {111} | 1.2/0.12 | 1.234 | −0.002 |

Both the AgICl {100} tabular grain emulsions and the AgIBr {111} tabular grain emulsions demonstrate increasing pressure desensitization as the mean ECD's increase, as expected. Comparing emulsions 3C and 7C it is apparent that at lower mean ECD's the AgICl {100} tabular grain emulsions and the AgIBr {111} tabular grain emulsions both demonstrate similar, negligible levels of pressure desensitization.

What was entirely unexpected was that the AgICl {100} tabular grain emulsion 1E with a mean ECD of 3.7 μm exhibited a much lower pressure desensitization than the AgIBr {111} tabular grain emulsion 5C with a mean ECD of 3.0 μm. This demonstrates a superior resistance of pressure desensitization by the AgICl {100} tabular grain emulsions satisfying the requirements of the invention.

This example indicates that superior performance can be expected from the photographic elements of the invention when locally subjected to pressures ranging from 20.0 to 70.0 MPa.

Example 3

This example demonstrates that the AgICl {100} tabular grain emulsions satisfying invention requirements do not require an iridium dopant to achieve the same low levels of reciprocity failure exhibited by iridium doped AgIBr {111} tabular grain emulsions.

The emulsion evaluations of Example 1 were repeated, except that the responses of the samples at a density of 0.15 above fog were compared with exposure times of 1 second and $1\times10^{-5}$ second. The reciprocity failure is reported in units of Δlog H×100, where the negative units indicate a lower speed than predicted by the law of reciprocity at an exposure of 1 second as compared to the speed observed at an exposure of $1\times10^{-5}$ second. The results are summarized below in Table III.

TABLE III

| Emul. | Tabular Type | ECD/t (μm) | Ir Doped | Δlog H X 100 |
|---|---|---|---|---|
| 4C | AgIBr {111} | 5.8/0.13 | No | −33 |
| 1E | AgICl {100} | 4.7/0.20 | No | −12 |
| 5C | AgIBr {111} | 3.7/0.13 | Yes | −10 |
| 2E | AgICl {100} | 3.0/0.14 | No | −10 |
| 6C | AgIBr {111} | 2.2/0.13 | Yes | −9 |
| 3C | AgICl {100} | 1.4/0.16 | No | −2 |

From Table III it is apparent that there is a general trend for reciprocity failure to increase as mean grain ECD is increased. The presence of iridium in the AgIBr {111} tabular grains restrains reciprocity failure. The AgICl {100} tabular grain emulsions show lower levels of reciprocity failure than expected, based on their mean ECD's, even if they had been iridium doped. Achieving such low levels of reciprocity failure without iridium doping was entirely unexpected.

Example 4

Whenever the possibility of introducing photographic films with substantially higher speeds than are currently available is considered, a question arises as to the susceptibility of the higher speed film to high energy background radiation (a.k.a. cosmic radiation). Since there is no way to shield photographic film from cosmic radiation, a higher susceptibility translates into placing shorter expiration dates on the film to insure that the film user obtains acceptable minimum densities.

This example compares the susceptibility of emulsions to high energy background radiation exposure, simulated by a 200 milliRoentgen (mR) exposure from a $^{60}$Co isotope radiation source, reported as the increase in minimum density, ΔDmin/200mR. The emulsions compared correspond to the like-numbered emulsions in Example 1. The emulsions were coated, light exposed and processed as in Example 1, except that the imaging layer unit coatings differed as follows: 0.81 g/m$^2$ Ag, 1.80 g/Ag mole TAI, and 1.62 g/m$^2$ gelatin and the overcoat contained 1.62 g/m$^2$ gelatin. The exposure used to determine speed was $1\times10^{-2}$ second. Speed was measured at 0.15 above fog. Relative speed differences are differences in log speed units (30 units=0.30 log E, where E is exposure in lux-seconds). The results are summarized in Table IV.

TABLE IV

| Emul. | Tabular Type | ECD/t (μm) | Dmin | Rel. Speed | ΔDmin /200 mR |
|---|---|---|---|---|---|
| 1E | AgICl {100} | 4.7/0.20 | 0.250 | 167 | 0.098 |
| 2E | AgICl {100} | 3.0/0.14 | 0.194 | 151 | 0.104 |
| 5C | AgIBr {111} | 3.7/0.13 | 0.136 | 141 | 0.124 |
| 6C | AgIBr {111} | 2.2/0.13 | 0.136 | 122 | 0.083 |
| 3C | AgICl {100} | 1.4/0.16 | 0.105 | 100 | 0.031 |

Whereas it was expected that susceptibility to background radiation would rise with the relative speed of the photographic film, it was discovered that the AgICl {100} tabular grain emulsions 1E and 2E, satisfying invention requirements, demonstrated lower increases in minimum density as a function of exposure to 200 mR of high energy radiation than the 5C lower speed AgIBr {111} tabular grain emulsion containing photographic element. This advantageous relative insensitivity of the photographic elements of the invention to high energy radiation was entirely unexpected.

This example indicates that photographic elements of the invention when subjected to from 50 to 500 mR of background radiation prior to processing exhibit superior imaging properties as compared to conventional photographic elements most nearly approaching the photographic elements of the invention in sensitivity levels.

Example 5

The processing undertaken in the preceding examples is entirely adequate for the photographic elements of the invention, but it is a processing cycle that was created for silver iodobromide emulsions.

To demonstrate the rapid processing capabilities of the AgICl {100} tabular grain emulsion containing photographic elements of the invention, Example 1 was repeated, but with development times reduced from 3 minutes, 15 seconds to 90 seconds. The results are summarized in Table V.

TABLE V

| Emul. | Tabular Type | ECD/t (μm) | Dmin | γ | S (1/H) |
|---|---|---|---|---|---|
| 1E | AgICl {100} | 4.7/0.20 | 0.067 | 0.69 | 432 |
| 2E | AgICl {100} | 3.0/0.14 | 0.069 | 1.54 | 367 |
| 5C | AgIBr {111} | 3.7/0.13 | 0.063 | 0.61 | 266 |
| 4C | AgIBr {111} | 5.8/0.13 | 0.057 | 0.43 | 193 |
| 6C | AgIBr {111} | 2.2/0.13 | 0.090 | 0.72 | 188 |
| 7C | AgIBr {111} | 1.2/0.12 | 0.083 | 1.03 | 122 |
| 3C | AgICl {100} | 1.4/0.16 | 0.054 | 2.47 | 101 |

The results shown in Table V corroborate the observations discussed above in Example 1, reported in Table I. In addition, the capability of the AgICl {100} tabular grain emulsions to produce useful images with shorter processing times is additionally demonstrated. Thus, development of the photographic elements of the invention in less than 2 minutes is specifically contemplated.

The invention has been described in detail with particular reference to preferred embodiments thereof, but it will be understood that variations and modifications can be effected within the spirit and scope of the invention.

What is claimed is:

1. A method of imagewise exposing to at least one of green and red light a dye image forming photographic element comprised of a transparent film support and, coated on the support, at least one layer unit containing a silver halide emulsion containing chemically sensitized silver halide grains, adsorbed to the silver halide grains a spectral sensitizing dye having a peak absorption in the green or red region of the spectrum to which the photographic element is imagewise exposed, a dye-forming coupler and a dispersing medium, wherein exposure of at least one portion of the photographic element is limited to $1.33\times10^{-3}$ lux-seconds and at least 50 percent of the projected area of the silver halide grains is accounted for by grains (a) containing greater than 50 mole percent chloride, based on silver, (b) having {100} major faces, (c) exhibiting a thickness of 0.2 μm or less, (d) exhibiting a mean equivalent circular diameter in the range of from 3 to 6 μm, and (e) including a core and a surrounding band containing up to 30 percent of the silver forming the grains and a higher level of iodide ions than the core, so that when the photographic element is developed for 3 minutes and 15 seconds at 38° C. in a developer of the composition:

| | |
|---|---|
| Potassium carbonate, anhydrous | 34.30 g |
| Potassium bicarbonate | 2.32 g |
| Sodium sulfite, anhydrous | 0.38 g |
| Sodium metalsulfite | 2.78 g |
| Potassium iodide | 1.20 mg |
| Sodium bromide | 1.31 g |
| Diethylenetriaminepentaacetic acid, Pentasodium salt (40% solution) | 8.43 g |
| Hydroxylamine sulfate | 2.41 g |
| Water to 1 Liter | |
| pH 10 | |

and subsequently bleached and fixed, it exhibits a density above fog of at least 0.15 in the at least one portion of the photographic element receiving the exposure of $1.33\times10^{-3}$ lux second.

2. A method according to claim 1 wherein the at least one layer unit is a red recording layer unit and the photographic element additionally contains a green recording layer unit of at least equal sensitivity.

3. A method according to claim 2 wherein the photographic element is a color reproduction element that contains blue, green and red recording layer units.

4. A method according to claim 1 wherein the photographic element is developed for less than 2 minutes to produce a dye image.

5. A method according to claim 1 wherein the photographic element in at least one imaging location receives from 20.0 to 70.0 MPa of applied pressure prior to exposure.

6. A method according to claim 1 wherein the photographic element receives from 50 to 500 mR of background radiation prior to development.

7. A dye image forming photographic element comprised of a transparent film support and, coated on the support, at least one layer unit containing a silver halide emulsion containing chemically sensitized silver halide grains, a spectral sensitizing dye having a peak absorption in the green or red region of the spectrum adsorbed to the silver halide grains, a dye-forming coupler and a dispersing medium, wherein at least 50 percent of the projected area of the silver halide grains is accounted for by grains (a) containing greater than 50 mole percent chloride, based on silver, (b) having {100} major faces, (c) exhibiting a thickness of 0.2 μm or less, (d) exhibiting a mean equivalent circular diameter in the range of from 3 to 6 μm, and (e) including a core and a surrounding band containing up to 30 percent of the silver forming the grains and a higher level of iodide ions than the core the photographic element exhibiting a sensitivity of greater than 750, where sensitivity is measured as the reciprocal of the exposure in lux-seconds required to produce a density of 0.15 above fog when the photographic element is exposed to a 3000° K. tungsten light source filtered to transmit light between 460 and 700 nm and developed for 3 minutes and 15 seconds at 38° C. in a developer of the composition:

| | |
|---|---|
| Potassium carbonate, anhydrous | 34.30 g |
| Potassium bicarbonate | 2.32 g |
| Sodium sulfite, anhydrous | 0.38 g |
| Sodium metalsulfite | 2.78 g |
| Potassium iodide | 1.20 mg |
| Sodium bromide | 1.31 g |
| Diethylenetriaminepentaacetic acid, pentasodium salt (40% solution) | 8.43 g |
| Hydroxylamine sulfate | 2.41 g |
| Water to 1 Liter | |
| pH 10 | |

and subsequently bleached and fixed.

8. A dye image forming photographic element according to claim 7 wherein the silver halide grains satisfying (a), (b), (c), (d) and (e) account for at least 70 percent of total grain projected area.

9. A dye image forming photographic element according to claim 7 wherein the core accounts for at least 25 percent of the silver forming the grains and the surrounding band constitutes up to 5 percent of the total silver forming the contains from 0.1 to 2 mole percent higher iodide than the core.

10. A dye image forming photographic element according to claim 7 wherein the photographic element contains blue, green and red recording layer units and at least one of the green and red recording layer units contain silver halide grains accounting for at least 70 percent of total grain projected area that satisfy (a), (b), (c), (d) and (e).

11. A dye image forming photographic element according to claim 7 wherein the silver halide grains that satisfy (a), (b), (c), (d) and (e) contain a dopant capable of providing shallow electron trapping sites.

12. A dye image forming photographic element according to claim 11 wherein the silver halide grains contain a hexacoordination complex satisfying the formula:

$$[M(CN)_6]^n$$

where M is $Fe^{+2}$, $Ru^{+2}$, or $Os^{+2}$, and n is −4.

* * * * *